United States Patent [19]

Lyon

[11] Patent Number: 4,971,145

[45] Date of Patent: Nov. 20, 1990

[54] HEAT EXCHANGER HEADER

[75] Inventor: Peter A. Lyon, Lockport, N.Y.

[73] Assignee: General Motors Corporation, Detroit, Mich.

[21] Appl. No.: 506,049

[22] Filed: Apr. 9, 1990

[51] Int. Cl.[5] ..... F28F 9/02

[52] U.S. Cl. ..... 165/173; 165/906; 29/890.039; 29/890.040; 29/890.052

[58] Field of Search ..... 165/150, 173, 174, 906; 29/890.039, 890.040, 890.043, 890.052

[56] References Cited

U.S. PATENT DOCUMENTS

| | | | |
|---|---|---|---|
| 2,028,456 | 5/1935 | Karmazin | 257/255 |
| 2,064,036 | 12/1936 | Sandberg | 113/118 |
| 2,064,141 | 12/1936 | Askin | 29/890.039 |
| 2,134,665 | 10/1938 | Karmazin | 165/174 |
| 2,295,087 | 3/1939 | Kleucker | 62/126 |
| 4,234,041 | 11/1980 | Melnyk | 29/890.052 |
| 4,360,060 | 11/1982 | Collgon | 165/173 |
| 4,386,652 | 6/1983 | Dragojevic | 165/144 |
| 4,485,867 | 12/1984 | Melnyk et al. | 165/173 |
| 4,775,006 | 10/1988 | Hesse | 165/150 |
| 4,903,389 | 2/1990 | Wolf | 29/890.043 |
| 4,917,180 | 4/1990 | Wolf et al. | 165/150 |

FOREIGN PATENT DOCUMENTS

| | | | |
|---|---|---|---|
| L16208 | 9/1956 | Fed. Rep. of Germany | 165/150 |
| 2478807 | 9/1981 | France | 165/150 |

*Primary Examiner*—John Rivell
*Assistant Examiner*—L. R. Leo
*Attorney, Agent, or Firm*—Ronald L. Phillips

[57] ABSTRACT

A heat exchanger header is formed of a tube plate and a header plate having indentations that cooperate with the tube plate to form a row of tank chambers for interconnecting heat exchanger tubes joined to the tube plate. The tube plate has ribs extending between adjacent tube apertures that are contacted at a point midway along their length by respective projections from the indentations on the tank plate.

3 Claims, 3 Drawing Sheets

HEAT EXCHANGER HEADER

FIELD OF THE INVENTION

This invention relates to heat exchanger headers and more particularly with respect to reinforcement of the header assembly.

BACKGROUND OF THE INVENTION

Tube and center heat exchangers such as used in motor vehicle air conditioning system condensers commonly have a plurality of parallel flat sided extruded tubes connected at opposite ends to a pair of headers and air centers between the tubes to facilitate efficient heat transfer to the surrounding area. The headers generally comprise a header plate with tube receiving apertures and a tank secured to the plate to supply refrigerant and receive same from the tubes. The air centers are brazed to the sides of adjacent tubes and the tubes are brazed or otherwise bonded to the header plates along with the tanks to assure leak free joints.

To enhance the ease of manufacture and reduce the cost while maintaining or improving durability and reliability, it has been proposed to form the headers as a laminated construction, as disclosed in U.S. patent application Ser. No. 07/200,321 filed May 31, 1988, now U.S. Pat. No. 4,903,389 and assigned to the assignee of this invention. In that arrangement, the headers simply comprise a flat inner tube plate that is apertured for receiving the ends of the tubes and serves as one side of the passage means. A flat outer tank plate is then aligned with and spaced from the inner plate and serves as a second side of the passage means. And a flat spacer plate conforming to and bonded between the margins of the inner tube plate and the outer tank plate acts to form the remaining boundaries of the passage means with the thickness of the spacer defining the spacing of the inner and outer plates to provide flow passages connecting the tube ends. This arrangement provides for improved burst pressure and low tooling costs and, in addition, enables a design flexibility which is important to allow selection of the number of passes, etc., with a minimal change in the structure in the manufacturing process.

SUMMARY OF THE INVENTION

The present invention provides a further improved heat exchanger header that eliminates the need for a spacer plate as in the laminated header construction discussed above by simply forming indentations in a tank header plate and by then providing ribs in the tube header plate that are contacted at a point intermediate their length by a corresponding projection also formed in the tank header plate. Braze cladding is provided on the plates for effecting brazing of the plates at their mating surfaces and also the points of contact between the projections and ribs. The result is a very rigid header construction consisting of only two plates with enhanced burst pressure strength that allows a reduction in plate thickness and/or increase in core depth as compared with prior designs yet retains design flexibility and ease of manufacture like in the above discussed laminated construction. Moreover, it has been found that imposition of the ribs and contacting projections in the flow path through the tank chambers effects mixing of the fluid as it flows from one tube pass to another thereby promoting uniformity of temperature across the refrigerant for better heat transfer with the surrounding air. In addition, it has been found that this plate type of construction with enhanced strength has significantly less internal volume than a corresponding cylindrical type tank and thus allows the use of a smaller refrigerant charge in the system both for leak testing in the manufacturing process and when installed in the end use air conditioning system.

It is therefore an object of the present invention to provide a new and improved heat exchanger header.

Another object is to provide a heat exchanger header having a tube header plate and a tank header plate wherein the tube header plate is ribbed between adjacent tube apertures and the tank header plate is indented to form tank chambers and is also formed with projections in the indentations that contact the ribs on the tube header plate at a point intermediate their length to provide reinforcement of the header construction.

Another object is to provide an improved heat exchanger header that is easy to fabricate and flexible in design, and more cost effective than prior designs.

BRIEF DESCRIPTION OF THE DRAWINGS

The above and other objects, advantages and features of the invention will become more apparent from the following description taken in conjunction with the accompanying drawings wherein like references refer to like parts and wherein.

DESCRIPTION OF THE PREFERRED EMBODIMENT

While the ensuing description is directed to a condenser for a motor vehicle air conditioning system, the invention clearly applies to other heat exchangers as well.

Figure 1:
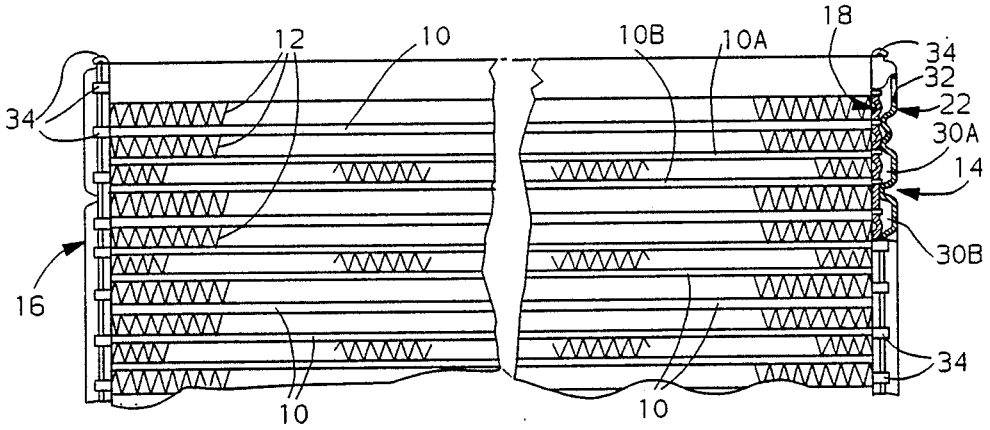
FIG. 1 is a partial front view of a condenser having a preferred embodiment of the headers according to the invention.

Referring to FIG. 1, the condenser there shown comprises a plurality of flat sided extruded tubes 10 arranged in parallel relationship and air centers 12 of sinusoidal configuration arranged therebetween for thermal coupling of the tubes with the ambient air. The ends of the tubes 10 are connected to headers 14 and 16 that interconnect the tubes for passes across the condenser and also provide for connection of the condenser in the system.

Figure 2:
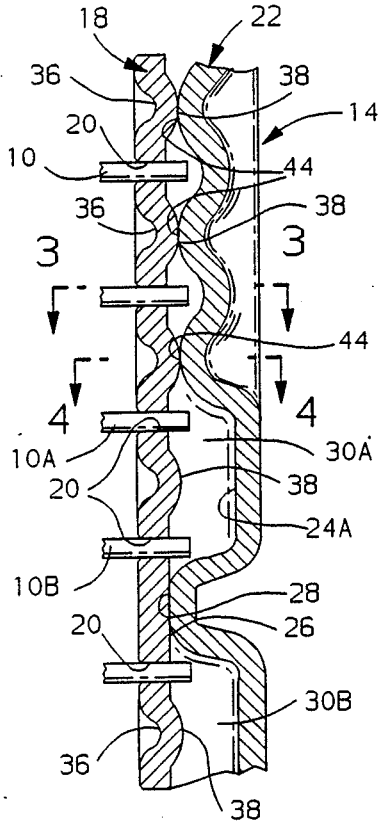
FIG. 2 is an enlarged view of the broken away section in FIG.1.
Figure 3:
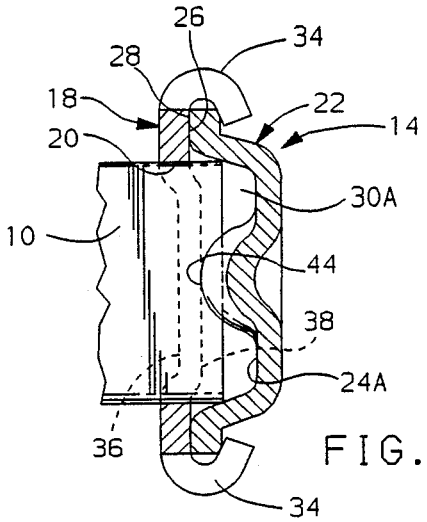
FIG. 3 is a view taken along the line 3—3 in FIG. 2.
Figure 4:
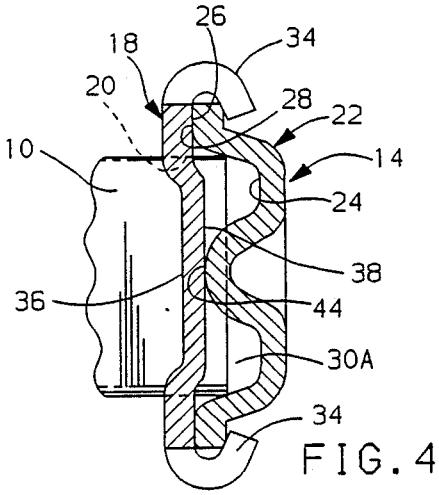
FIG. 4 is a view taken along the line 4—4 in FIG. 2.
Figure 7:
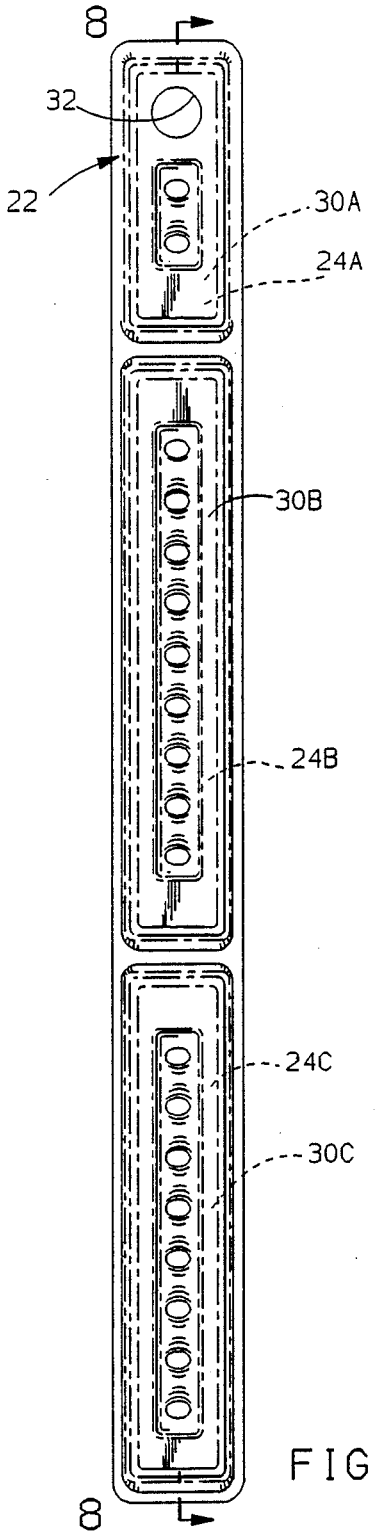
FIG. 7 is an air side view of one of the tank header plates in FIG. 1.
Figure 8:
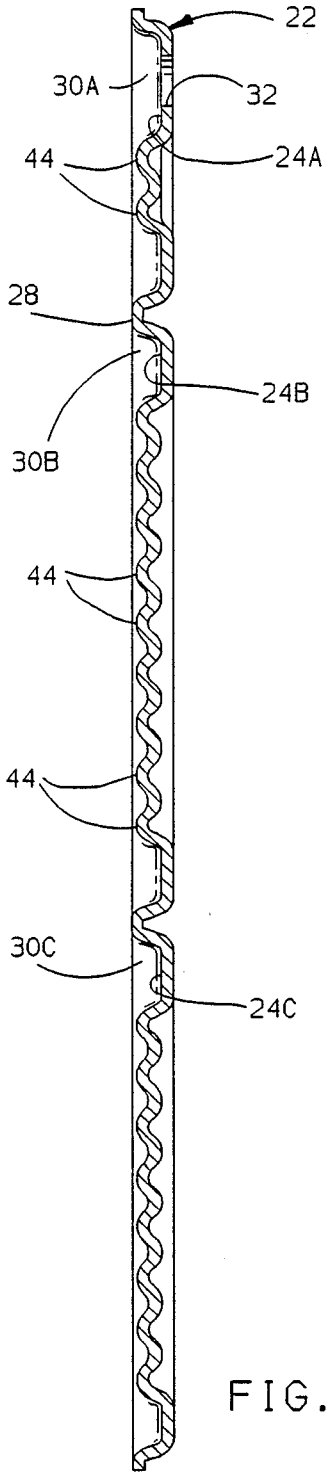
FIG. 8 is a view taken along the line 8—8 in FIG. 7.

The header 14 is formed of two plates (see FIGS. 2–8): namely, a tube plate 18 having apertures 20 for receiving the tubes 10 and a tank plate 22 having indentations 24A, 24B and 24C in one side thereof, of about twice the metal thickness in depth, facing the tube plate as seen in FIGS. 2–4. The tube and tank plates 18 and 22 have mating surfaces 26 and 28 surrounding the indentations so that the latter in cooperation with the header plate define a row of tank chambers 30A, 30B and 30C open to selected ones of the tubes. For example, in the condenser arrangement shown, there are six tubes per pass and an odd number of passes, namely five, so that the inlet and outlet for the condenser are at opposite corners thereof. On the other hand, where an even number of passes is provided, the outlet and inlet will be in the same header. Thus the characteristics of differnt condenser models can be designed by the selection of the indentations, thereby giving flexibility in design. For the fitting connection at the header 14, the tank plate 22 has an aperture 32 in the upper indentation 24A (see FIG. 7) for receiving a tube fitting (not shown) for connecting one end of the flow circuit of the condenser in the air conditioning system.

The plates are of uniform but not necessarily the same thickness as shown and are preferably of heavy gage, for example, 3.2 mm, so that secure connections can be made with the tubes and tube fittings to achieve high burst pressure capability. In addition, clinch tabs 34 are spaced about and extend outwardly from the margin of the tube plate and are adapted to be clinched over the margin of the tank plate as shown in FIGS. 3 and 4 to hold these parts together in preparation for brazing as described in more detail later. The indentations in the tank plate taper to a width less than the width of the tubes as seen with 24A in FIGS. 3 and 4 so that the sides of the respective indentations serve as a stop for midway positioning of the ends of the tubes in the headers to prevent their being blocked by the tank plate.

The header 16 is the same as the header 14 except that a tube fitting aperture is provided in the tank header plate at the opposite end or corner of the condenser from the fitting aperture 32 with it being understood that either one can serve as an inlet or outlet and the other then serve the other function. And the chamber forming indentations in one header are staggered relative to those in the other header so that they cooperatively define a serpentine flow path through the condenser comprised of the several passes.

Figure 5:
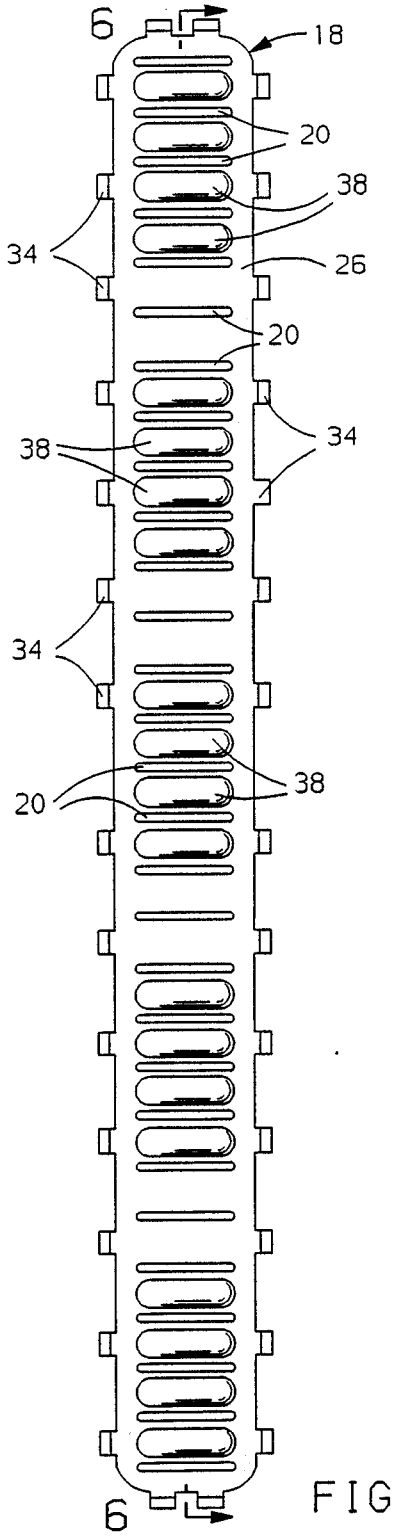
FIG. 5 is a tank side view of one of the tube header plates in FIG. 1.
Figure 6:
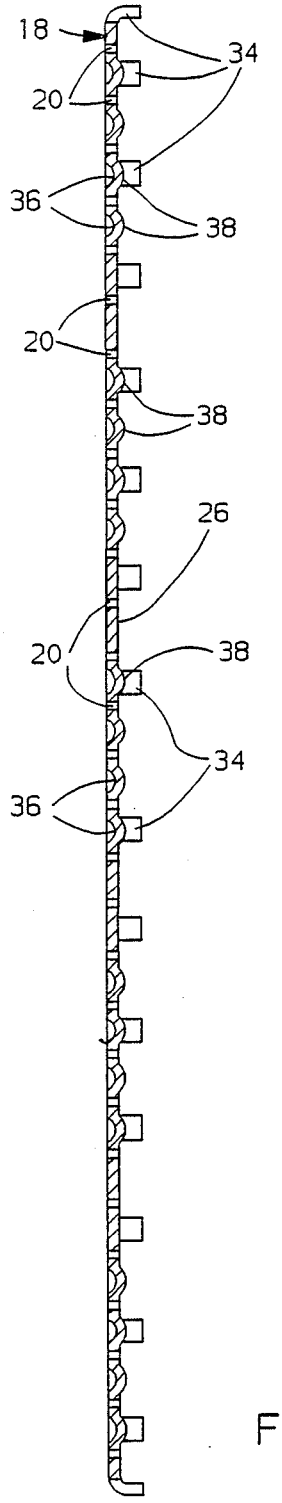
FIG. 6 is a view taken along the line 6—6 in FIG. 5.

According to the present invention, significantly enhanced strength is added to the header by each of the tube plates having a row of indentations 36 forming raised ribs 38 on the tank or pressure side of the plate extending between selected adjacent ones of the tube apertures. The height of the ribs as seen in FIGS. 2, 3, 4 and 6 is about half the thickness of the material which is a very readily formable stamping operation and adds substantial strength immediately adjacent the tube ends. As seen in FIG. 5, the ribs 38 (36) extend substantially the length of the adjacent tube apertures and have a generous radius so as not to present stress risers. The tank plate, on the other hand, is dimpled in the areas of its indentations 24 so as to have oval shaped projections 44 on its interior or pressure side which each contact selected ones of the ribs at a point intermediate the length of the rib as best seen in FIGS. 3 and 4.

Conventional aluminum heat exchanger materials are employed so that conventional brazing can be used. All the parts comprise a base material of aluminum 3003 and are clad with aluminum 4343 which serves as brazing material. Alternatively, other alloy combinations appropriate to the intended brazing process may be used. With braze cladding thus on the oppositely facing sides of the tube and header plates, there is provided brazing of the plates at both the mating surfaces 26 and 28 and at the points of contact between the projections 44 and ribs 38 resulting in a highly rigid reinforced header structure throughout its width and length.

To limit thin out of the stock during projections of the deeper tank indentations 24, the projections are eliminated therein between the two tubes 10A and 10B nearest the end of the respective tank sections as seen in FIG. 2. It has been found that this also tends to more evenly distribute the flow of refrigerant through the tube to tank passages. Furthermore, it is found that the contact points between the reinforcing projections and ribs provide mixing of the refrigerant as it passes through the tank sections, thus providing uniformity of temperature in the refrigerant which makes for better heat transfer.

The foregoing description of the preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

The embodiment of the invention in which an exclusive property or privilege is claimed are defined as follows:

1. A heat exchanger header comprising a tube plate having tube apertures for receiving heat exchanger tubes, a tank plate having chamber indentations in one side thereof facing said tube plate, said plates having mating surfaces surrounding said indentations so as to define tank chambers open to selected ones of said tube apertures, said tube plate having indentations forming ribs extending between selected adjacent ones of said tube apertures, said tank plate having dimples in said chamber indentations forming projections on said one side contacting selected ones of said ribs at a point intermediate the length of the rib, and bonding material for effecting bonding of said plates at said mating surfaces and said points of contact between said projections and ribs.

2. A heat exchanger header comprising a tube plate of uniform thickness having a row of tube apertures for receiving heat exchanger tubes, a tank plate of uniform thickness having a row of chamber indentations in one side thereof facing said tube plate, said plates having mating surfaces surrounding said indentations so as to define a row of tank chambers open to selected ones of said tube apertures, said tube plate having a row of indentations forming ribs extending between selected adjacent ones of said tube apertures, said tank plate having dimples in said chamber indentations forming projections on said one side contacting selected ones of said ribs at a point intermediate the length of the rib, and bonding material for effecting bonding of said plates at said mating surfaces and said points of contact between said projections and ribs.

3. A heat exchanger header comprising an aluminum tube plate of uniform thickness having a row of tube apertures for receiving heat exchanger tubes, an aluminum tank plate of uniform thickness having a row of chamber indentations in one side thereof facing said tube plate, said plates having mating surfaces surrounding said indentations so as to define a row of tank chambers open to selected ones of said tube apertures, said tube plate having a row of indentations forming ribs extending between selected adjacent ones of said tube apertures, said tank plate having dimples in said chamber indentations corresponding only to those ribs located intermediate the two ribs nearest opposite ends of the respective chambers, said dimples forming projections on said one side of said tank plate contacting only the respective said intermediate ribs at a point intermediate the length of the rib, and braze cladding on said plates for effecting brazing of said plates at said mating surfaces and said points of contact between said projections and ribs.

* * * * *